US010297191B2

(12) United States Patent
Hoffman

(10) Patent No.: US 10,297,191 B2
(45) Date of Patent: May 21, 2019

(54) DYNAMIC NET POWER CONTROL FOR OLED AND LOCAL DIMMING LCD DISPLAYS

(71) Applicant: SAMSUNG DISPLAY CO., LTD., Yongin-si, Gyeonggi-do (KR)

(72) Inventor: David M. Hoffman, Fremont, CA (US)

(73) Assignee: Samsung Display Co., Ltd., Yongin-si (KR)

( * ) Notice: Subject to any disclaimer, the term of this patent is extended or adjusted under 35 U.S.C. 154(b) by 90 days.

(21) Appl. No.: 15/239,743

(22) Filed: Aug. 17, 2016

(65) Prior Publication Data

US 2017/0221413 A1 Aug. 3, 2017

Related U.S. Application Data

(60) Provisional application No. 62/288,794, filed on Jan. 29, 2016.

(51) Int. Cl.

| | |
|---|---|
| ***G09G 3/36*** | (2006.01) |
| ***G09G 3/34*** | (2006.01) |
| ***G09G 3/32*** | (2016.01) |
| ***G09G 3/3208*** | (2016.01) |

(52) U.S. Cl.

CPC ..... *G09G 3/3208* (2013.01); *G09G 3/3426* (2013.01); *G09G 3/36* (2013.01); *G09G 2320/0261* (2013.01); *G09G 2320/041* (2013.01); *G09G 2320/062* (2013.01); *G09G 2320/0646* (2013.01); *G09G 2330/021* (2013.01); *G09G 2330/045* (2013.01); *G09G 2360/16* (2013.01)

(58) Field of Classification Search

None

See application file for complete search history.

(56) References Cited

U.S. PATENT DOCUMENTS

| | | | |
|---|---|---|---|
| 5,451,979 | A | 9/1995 | Levac |
| 6,147,664 | A | 11/2000 | Hansen |
| 6,291,942 | B1 | 9/2001 | Odagiri et al. |
| 6,762,742 | B2 | 7/2004 | Moon et al. |
| 7,242,153 | B2 | 7/2007 | Yu et al. |

(Continued)

FOREIGN PATENT DOCUMENTS

| | | | |
|---|---|---|---|
| CN | 1996454 | A | 7/2007 |
| CN | 101217021 | A | 7/2008 |

(Continued)

OTHER PUBLICATIONS

EPO Extended Search Report dated Jun. 16, 2017, for corresponding European Patent Application No. 17153820.0 (10 pages).

(Continued)

*Primary Examiner* — Reza Aghevli

(74) *Attorney, Agent, or Firm* — Lewis Roca Rothgerber Christie LLP

(57) ABSTRACT

A method of power control of a display system, the method including receiving dynamic metadata corresponding to input image data, determining a panel load level of the display system based on the dynamic metadata, and applying a first net power control (NPC) function to the display system during a first scene based on the panel load level.

25 Claims, 7 Drawing Sheets

(56) References Cited

U.S. PATENT DOCUMENTS

| | | | | |
|---|---|---|---|---|
| 7,808,461 | B2 * | 10/2010 | Yamazaki | G09G 3/20 315/169.1 |
| 7,925,903 | B2 | 4/2011 | Varma et al. | |
| 8,077,137 | B2 | 12/2011 | Lee | |
| 8,130,325 | B2 * | 3/2012 | Iwakura | G09G 3/288 348/673 |
| 8,279,144 | B2 | 10/2012 | Zhao et al. | |
| 8,471,876 | B2 | 6/2013 | Byun et al. | |
| 8,531,446 | B2 | 9/2013 | Woo et al. | |
| 8,537,081 | B2 | 9/2013 | Awakura et al. | |
| 8,624,828 | B2 | 1/2014 | Uchimoto et al. | |
| 8,854,399 | B2 * | 10/2014 | Arkhipov | G09G 3/32 345/208 |
| 9,093,028 | B2 | 7/2015 | Chaji | |
| 9,134,825 | B2 | 9/2015 | Chaji | |
| 9,171,504 | B2 | 10/2015 | Azizi et al. | |
| 9,232,579 | B2 | 1/2016 | Sasaki et al. | |
| 9,257,072 | B2 * | 2/2016 | Han | G09G 3/3233 |
| 9,262,965 | B2 | 2/2016 | Chaji et al. | |
| 9,269,301 | B2 * | 2/2016 | Lee | G09G 3/3258 |
| 9,633,601 | B2 * | 4/2017 | Cheon | G09G 3/3233 |
| 2004/0046718 | A1 | 3/2004 | Osame et al. | |
| 2004/0201582 | A1 | 10/2004 | Mizukoshi et al. | |
| 2005/0068270 | A1 | 3/2005 | Awakura et al. | |
| 2005/0116657 | A1 | 6/2005 | Park et al. | |
| 2005/0231497 | A1 * | 10/2005 | Harada | G09G 3/3614 345/204 |
| 2006/0244697 | A1 | 11/2006 | Lee et al. | |
| 2007/0008297 | A1 | 1/2007 | Bassetti | |
| 2007/0080905 | A1 | 4/2007 | Takahara | |
| 2007/0152937 | A1 | 7/2007 | Jung et al. | |
| 2007/0182672 | A1 | 8/2007 | Hoppenbrouwers et al. | |
| 2008/0002103 | A1 | 1/2008 | Lee | |
| 2008/0055289 | A1 | 3/2008 | Kim et al. | |
| 2008/0074382 | A1 | 3/2008 | Lee et al. | |
| 2008/0158218 | A1 | 7/2008 | Kim | |
| 2008/0180367 | A1 | 7/2008 | Lee | |
| 2009/0006901 | A1 * | 1/2009 | Brey | G06F 1/206 714/47.1 |
| 2009/0027375 | A1 | 1/2009 | Ryu et al. | |
| 2009/0033602 | A1 | 2/2009 | Alexander et al. | |
| 2009/0122003 | A1 | 5/2009 | Chen et al. | |
| 2009/0147032 | A1 | 6/2009 | Kim | |
| 2009/0201232 | A1 | 8/2009 | Kim | |
| 2010/0171733 | A1 | 7/2010 | Kobayashi | |
| 2010/0171774 | A1 | 7/2010 | Mizukoshi et al. | |
| 2010/0328365 | A1 | 12/2010 | Ikeda et al. | |
| 2011/0012819 | A1 | 1/2011 | Ryu et al. | |
| 2011/0115832 | A1 | 5/2011 | Lee et al. | |
| 2011/0157141 | A1 | 6/2011 | Woo et al. | |
| 2011/0193489 | A1 | 8/2011 | Moss | |
| 2011/0267375 | A1 | 11/2011 | Yang et al. | |
| 2011/0316893 | A1 | 12/2011 | Lee et al. | |
| 2013/0257845 | A1 | 10/2013 | Chaji et al. | |
| 2014/0146066 | A1 * | 5/2014 | Kang | G09G 3/3225 345/545 |
| 2014/0333603 | A1 | 11/2014 | Choi | |
| 2014/0333680 | A1 | 11/2014 | Chpo | |
| 2014/0340379 | A1 | 11/2014 | Kim et al. | |
| 2014/0354698 | A1 | 12/2014 | Lee et al. | |
| 2015/0029394 | A1 | 1/2015 | Fernandes et al. | |
| 2015/0049070 | A1 | 2/2015 | Ren et al. | |
| 2015/0116300 | A1 | 4/2015 | Yamaki et al. | |
| 2015/0243218 | A1 | 8/2015 | Tseng et al. | |
| 2015/0294622 | A1 | 10/2015 | Chaji | |
| 2016/0117970 | A1 | 4/2016 | Matsui | |

FOREIGN PATENT DOCUMENTS

| | | | | |
|---|---|---|---|---|
| EP | 1310935 | A2 * | 5/2003 | G09G 3/22 |
| EP | 1310935 | A2 | 5/2003 | |
| EP | 1577865 | A2 * | 9/2005 | G09G 3/20 |
| EP | 1942485 | A2 | 7/2008 | |
| EP | 2093747 | A1 | 8/2009 | |
| KR | 10-2007-0072149 | A | 7/2007 | |
| KR | 10-2007-0092856 | A | 9/2007 | |
| KR | 10-2008-0027421 | A | 3/2008 | |
| KR | 10-2008-0064525 | A | 7/2008 | |
| KR | 10-2009-0012381 | A | 2/2009 | |
| KR | 10-2009-0125414 | A | 12/2009 | |
| KR | 10-2010-0021094 | A | 2/2010 | |
| KR | 10-2013-0055256 | A | 5/2013 | |
| KR | 10-2014-0048691 | A | 4/2014 | |
| WO | WO 2008/142602 | A2 | 11/2008 | |
| WO | WO 2009/148244 | A2 | 12/2009 | |

OTHER PUBLICATIONS

Arkhipov, Alexander, et al., "Using Net Power Control for AMOLED TV," IMID 2007 Digest, pp. 47-50, 4 pages.

European Search Report dated Nov. 16, 2011, for corresponding European Patent Application No. 11178119.1 (10 pages).

* cited by examiner

DYNAMIC NET POWER CONTROL FOR OLED AND LOCAL DIMMING LCD DISPLAYS

CROSS-REFERENCE TO RELATED APPLICATIONS

This application claims priority to, and the benefit of, U.S. Provisional Patent Application No. 62/288,794, titled "DYNAMIC NET POWER CONTROL FOR DISPLAYS," filed in the United States Patent and Trademark Office on Jan. 29, 2016, the entire disclosure of which is incorporated herein by reference.

BACKGROUND

1. Field

Embodiments of the present invention relate to display systems.

2. Related Art

A variety of display devices/display systems have been developed. Examples thereof include liquid crystal display (LCD) devices and organic light emitting display (OLED) devices. These displays are lighter in weight than, and smaller in volume than, conventional cathode ray tube displays.

OLED displays and local dimming LCDs use a subset of individual emitters (e.g., OLEDs of pixels, or LEDs for driving backlight units of an LCD) to depict imagery in different parts of a panel/display screen of the display system to represent the displayed image. By activating the emitters, light is produced from a panel of the display system. By displaying bright objects having a larger size in the displayed image, the total number of active emitters increases along with a total power demand of the display system. If the total number of emitters becomes too large, due to limitations of the display system, it might not be feasible to power all of the emitters at an intensity at which a small number of active emitters could be powered.

For example, by driving the panel to be entirely white, the aggregate power used by all emitters may be large. That is, because the total power required to drive a relatively small number of active emitters at a particular intensity in a relatively small area of the panel is less than the power required to drive a larger number of active emitters in a larger area at the same intensity, the display system may not be engineered to be able to suitably supply the power load used to drive the large number of active emitters at that intensity.

Accordingly, display systems may incorporate a form of net power control (NPC) that decreases a global gain/NPC gain of all emitters as the total system load gets larger as a function of a number of the emitters, and as a function of respective intensities at which the emitters display light. That is, the overall brightness of the image may be dimmed as the number of active emitters operating at a relatively high intensity increases, thereby reducing the intensity of all of the active emitters, and thereby reducing the power draw for powering the active emitters and consequently reducing the image brightness as seen by an observer. The value/level of the global gain applied to the image is determined by a NPC function/algorithm, and corresponds to the loading of the panel (e.g., a panel load, or the amount of power used to drive the panel, which generally corresponds to the brightness of the panel). That is, the NPC function/NPC control signal may determine the global gain as a function of the total emitter load. By reducing the total system load by using a global gain function, the circuitry of the display system may be protected by preventing overload of a power supply of the display system that drives the emitters, preventing overload of power lines from the power supply to the emitters, or preventing excessive heat buildup.

A power control signal for driving the display panel is controlled by the NPC function, and is typically based on a power load estimate corresponding to the pixel data of each image frame of image data. In sequences of the image data that correspond to a change in the panel loading (e.g., a sudden change in the panel loading), the NPC function may decrease the global gain and thereby dim the active emitters (e.g., when the size of a relatively bright area on the panel increases, the brightness of that bright area may decrease). A user viewing the panel may detect a change (e.g. sudden change) in the image intensity corresponding to the change of the global gain. In some cases, the NPC function, which has generally been a static function for conventional display systems, can cause a 60% reduction or more in the brightness of the panel.

The above information disclosed in this Background section is only to enhance the understanding of the background of the invention, and therefore it may contain information that does not constitute prior art.

SUMMARY

Embodiments of the present invention are directed to power control of display panels.

According to one or more embodiments of the present invention, there is provided a method of power control of a display system, the method including receiving dynamic metadata corresponding to input image data, determining a panel load level of the display system based on the dynamic metadata, and applying a first net power control (NPC) function to the display system during a first scene based on the panel load level.

The method may further include receiving a second dynamic metadata corresponding to an input image data from a second scene, determining the panel load level of the display system based on the second dynamic metadata, and applying a second NPC function to the display during the second scene based on the panel load level.

The method may further include detecting the panel load level of the display system corresponding to a first image frame of the first scene, setting a NPC panel load basis value of the first NPC function to a first value according to a detected panel load level, detecting a panel load that exceeds an anticipated NPC function range caused by an increase in the panel load level at a second image frame of the first scene that is after the first image frame, and that is an out-of-range frame, and adjusting the NPC panel load basis value of the first NPC function to a second value that is higher than the first value upon the out-of-range frame.

The method may further include detecting a local peak in the panel load level during the first scene, wherein the second value is higher than the local peak.

The method may further include maintaining the second value as the NPC panel load basis value of the first NPC function until a second scene, or until detecting an additional local peak in the panel load level that is higher than the local peak.

The method may further include detecting a low panel load after the local peak in the panel load level, and readjusting the NPC panel load basis value of the first NPC function after the local peak in the panel load level at a constant decreasing rate.

The method may further include applying a second NPC function to a second scene occurring after a change in the panel load level, the first NPC function and the second NPC function being different.

The dynamic metadata may include information corresponding to at least one of a duration of one of the first scene or a second scene, a peak image brightness of one of the first or second scenes, a minimum image brightness one of the first or second scenes, an average brightness of an image frame of one of the first or second scenes, a maximum frame average luminance level (MaxFALL) of one of the first or second scenes, spatial information about image content of one of the first or second scenes, or suggested color model information of one of the first or second scenes.

The determining a change of scenes between image frames may include calculating one or more statistics corresponding to each of image frames corresponding to the input image data, storing the statistics, and comparing the statistics to determine that a first image frame of the image frames belongs to the first scene, and to determine that a second image frame of the image frames belongs to a second scene.

The method may further include setting a NPC function such that it minimizes fluctuations in image gain.

The first NPC function may be further based on a low power mode.

The method of claim 1, wherein the first NPC function is further based on an operating temperature of the display system exceeding a temperature threshold.

According to one or more embodiments of the present invention, there is provided a display system including display panel for displaying images according to input image data, a processor, and memory, wherein the memory has stored thereon instructions that, when executed by the processor, causes the processor to detect an interruption of a sequence of like-frames of the input image data, apply a first net power control (NPC) function to a first scene occurring before the interruption, and apply a second NPC function to a second scene occurring after the interruption, the first and second NPC functions being different.

The instructions, when executed by the processor, may further cause the processor to detect a panel load level of the display system corresponding to a first image frame of the first scene, set a NPC panel load basis value of the first NPC function to a first value according to a detected panel load level, detect any excesses in load caused by a change in the input image data at a second image frame of the first scene that is after the first image frame, and adjust the first NPC function to a second function such that a gain level is lower and thus more sustainable than the first value upon the detected excess in load.

The instructions, when executed by the processor, may further cause the processor to detect an elevated panel load level during the first scene, wherein the second function is higher than the elevated panel load level.

The instructions, when executed by the processor, may further cause the processor to maintain the second function as the NPC panel load basis value for determining an appropriate first NPC function until a second scene, or until detecting an additional elevated panel load level that is higher than a previous elevated panel load level.

The instructions, when executed by the processor, may further cause the processor to detect a low panel load after the elevated panel load level, and readjust the NPC panel load basis value of the first NPC function after the elevated panel load level at a measured rate.

The instructions, when executed by the processor, may further cause the processor to apply a second NPC function to a second scene occurring after a change in panel load level, the first NPC function and the second NPC function being different.

The instructions, when executed by the processor, may further cause the processor to detect dynamic metadata including information corresponding to at least one of a duration of one of the first scene or of a second scene, a peak image brightness of one of the first or second scenes, a minimum image brightness one of the first or second scenes, an average brightness of an image frame of one of the first or second scenes, a maximum frame average luminance level (MaxFALL) of one of the first or second scenes, spatial information about image content of one of the first or second scenes, or suggested color model information of one of the first or second scenes.

The instructions that cause the processor to determine a panel load level of the display system may cause the processor to calculate one or more statistics corresponding to each of image frames corresponding to the input image data, store the statistics, and compare the statistics to determine that a first image frame of the image frames belongs to the first scene, and to determine that a second image frame of the image frames belongs to a second scene.

The instructions, when executed by the processor, may further cause the processor to maintain a gain value of the first NPC function as substantially constant for the first scene.

The instructions, when executed by the processor, may further cause the processor to detect an interruption of a sequence of like frames of the input image data corresponding to a same scene using a dynamic metadata.

According to one or more embodiments of the present invention, there is provided a method of generating a non-static net power control (NPC) gain level for a display system, the method including detecting an image frame corresponding to a change in a brightness level, and adjusting the NPC gain level at the image frame.

The detecting an image frame corresponding to a change in a brightness level may include determining a panel load of the display system.

BRIEF DESCRIPTION OF THE DRAWINGS

The accompanying drawings, together with the specification, illustrate exemplary embodiments of the present invention, and, together with the description, serve to explain features of the present invention, wherein.

DETAILED DESCRIPTION

Figure 1A:
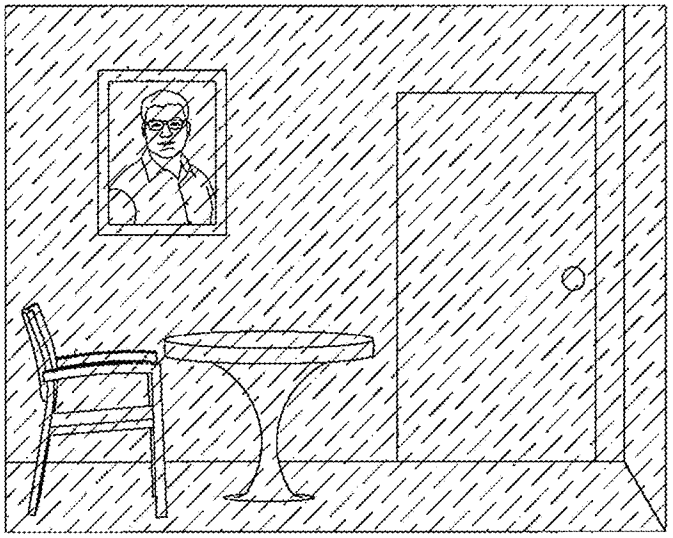
FIGS. 1A-1D illustrate sequential image frames of a scene in which brightness of the scene increases, and illustrate net power control (NPC) functions respectively corresponding thereto, according to an example of an embodiment of the present invention.
Figure 1A:
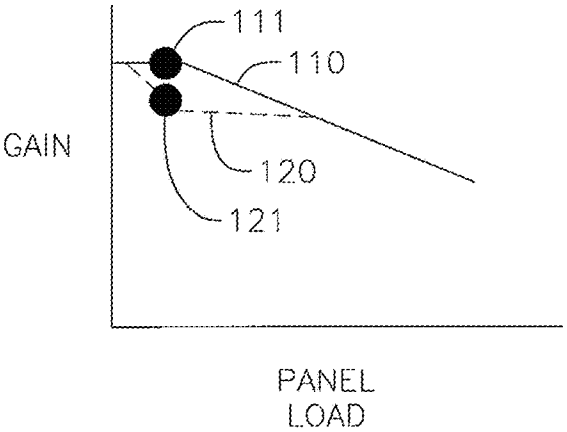

Features of the inventive concept and methods of accomplishing the same may be understood more readily by reference to the following detailed description of embodiments and the accompanying drawings. The inventive concept may, however, be embodied in many different forms and should not be construed as being limited to the embodiments set forth herein. Hereinafter, example embodiments will be described in more detail with reference to the accompanying drawings, in which like reference numbers refer to like elements throughout. The present invention, however, may be embodied in various different forms, and should not be construed as being limited to only the illustrated embodiments herein. Rather, these embodiments are provided as examples so that this disclosure will be thorough and complete, and will fully convey the aspects and features of the present invention to those skilled in the art. Accordingly, processes, elements, and techniques that are not necessary to those having ordinary skill in the art for a complete understanding of the aspects and features of the present invention may not be described. Unless otherwise noted, like reference numerals denote like elements throughout the attached drawings and the written description, and thus, descriptions thereof will not be repeated. In the drawings, the relative sizes of elements, layers, and regions may be exaggerated for clarity.

It will be understood that, although the terms "first," "second," "third," etc., may be used herein to describe various elements, components, regions, layers and/or sections, these elements, components, regions, layers and/or sections should not be limited by these terms. These terms are used to distinguish one element, component, region, layer or section from another element, component, region, layer or section. Thus, a first element, component, region, layer or section described below could be termed a second element, component, region, layer or section, without departing from the spirit and scope of the present invention.

Spatially relative terms, such as "beneath," "below," "lower," "under," "above," "upper," and the like, may be used herein for ease of explanation to describe one element or feature's relationship to another element(s) or feature(s) as illustrated in the figures. It will be understood that the spatially relative terms are intended to encompass different orientations of the device in use or in operation, in addition to the orientation depicted in the figures. For example, if the device in the figures is turned, over, elements described as "below" or "beneath" or "under" other elements or features would then be oriented "above" the other elements or features. Thus, the example terms "below" and "under" may encompass both an orientation of above and below. The device may be otherwise oriented (e.g., rotated 90 degrees or at other orientations) and the spatially relative descriptors used herein should be interpreted accordingly.

It will be understood that when an element or layer is referred to as being "on," "connected to," or "coupled to" another element or layer, it may be directly on, connected to, or coupled to the other element or layer, or one or more intervening elements or layers may be present. In addition, it will also be understood that when an element or layer is referred to as being "between" two elements or layers, it may be the only element or layer between the two elements or layers, or one or more intervening elements or layers may also be present.

The terminology used herein is for the purpose of describing particular embodiments only and is not intended to be limiting of the present invention. As used herein, the singular forms "a" and "an" are intended to include the plural forms as well, unless the context clearly indicates otherwise. It will be further understood that the terms "comprises," "comprising," "includes," and "including," when used in this specification, specify the presence of the stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items. Expressions such as "at least one of," when preceding a list of elements, modify the entire list of elements and do not modify the individual elements of the list.

As used herein, the term "substantially," "about," and similar terms are used as terms of approximation and not as terms of degree, and are intended to account for the inherent deviations in measured or calculated values that would be recognized by those of ordinary skill in the art. Further, the use of "may" when describing embodiments of the present invention refers to "one or more embodiments of the present invention." As used herein, the teens "use," "using," and "used" may be considered synonymous with the terms "utilize," "utilizing," and "utilized," respectively. Also, the term "exemplary" is intended to refer to an example or illustration.

The electronic devices or any other relevant devices or components according to embodiments of the present invention described herein may be implemented utilizing any suitable hardware, firmware (e.g. an application-specific integrated circuit), software, or a combination of software, firmware, and hardware. For example, the various components of these devices may be formed on one integrated circuit (IC) chip or on separate IC chips. Further, the various components of these devices may be implemented on a flexible printed circuit film, a tape carrier package (TCP), a printed circuit board (PCB), or formed on one substrate. Further, the various components of these devices may be a process or thread, running on one or more processors, in one or more computing devices, executing computer program instructions and interacting with other system components for performing the various functionalities described herein. The computer program instructions are stored in a memory which may be implemented in a computing device using a standard memory device, such as, for example, a random access memory (RAM). The computer program instructions may also be stored in other non-transitory computer readable media such as, for example, a CD-ROM, flash drive, or the like. Also, a person of skill in the art should recognize that the functionality of various computing devices may be combined or integrated into a single computing device, or the functionality of a particular computing device may be distributed across one or more other computing devices without departing from the spirit and scope of the exemplary embodiments of the present invention.

Unless otherwise defined, all terms (including technical and scientific terms) used herein have the same meaning as commonly understood by one of ordinary skill in the art to which the present invention belongs. It will be further understood that terms, such as those defined in commonly used dictionaries, should be interpreted as having a meaning that is consistent with their meaning in the context of the relevant art and/or the present specification, and should not be interpreted in an idealized or overly formal sense, unless expressly so defined herein.

Some portions of the following detailed descriptions are presented in terms of algorithms and/or symbolic representations of operations on data bits that may occur within a computer/server memory. These descriptions and representations are used by those skilled in the art of data compression to convey ideas, structures, and methodologies to others skilled in the art. An algorithm is a self-consistent sequence for achieving a desired result and requiring physical manipulations of physical quantities, which may take the form of electro-magnetic signals capable of being stored, transferred, combined, compared, replicated, reproduced, and otherwise manipulated. Such signals may be referred to as bits, values, elements, symbols, characters, terms, numbers, or the like. These and similar terms are associated with appropriate physical quantities, and are used as representative labels for these quantities. Accordingly, terms such as "processing," "computing," "calculating," "determining," "displaying" or the like, refer to the action and processes of a computing device or system that manipulates data represented as physical quantities within registers/memories into other data that is also represented by stored/transmitted/displayed physical quantities.

Embodiments of the present invention provide a method for changing a global gain, or a panel load basis, of a display panel of a display system using a net power control (NPC) function, and also provide a circuit that is able to anticipate different types of imagery that will be shown on the panel, and that is able to adjust the NPC function to provide increased stability of the image frames of image data corresponding to the imagery. Accordingly, embodiments of the present invention provide a display system that is able to reduce dramatic or sudden fluctuations in brightness for displayed parts of a scene or imagery when brightness stability is suitable or desired, and that is able to reduce visibility of display artifacts in dynamic scenes.

As used herein, the term "scene" may refer to a string of image frames, or a segment of adjacent image frames, in which only gradual changes (i.e., no abrupt or dramatic changes) in brightness and/or panel loading occurs. Accordingly, different "scenes," as used herein, may actually be part of the same scene in a cinematographic sense (e.g., a single scene may be any continuous set of image frames from a single camera shot). For example, as used herein, different "scenes" may be demarcated by sudden cut in which the image depicts a different time or place, demarcated by switching between cameras views of different angles of the same event, or demarcated by any abrupt/sudden change in light level/overall brightness, such as an explosion, a camera flash, or a bolt of lightning.

FIGS. 1A-1D illustrate sequential image frames of a scene in which brightness of the scene increases, and illustrate NPC functions respectively corresponding thereto, according to an example of an embodiment of the present invention.

In the present example, FIG. 1A depicts an image frame of a dark, or dimly lit room at a beginning of a scene, and also depicts a first, conventional NPC function 110 and a second NPC function 120 according to the present embodiment. Because the image depicted in FIG. 1A is dimly lit, panel loading associated with the image frame is also low (e.g., 5%). As the image frames of the scene depicted in FIGS. 1A-1D progress, a door from the dimly lit room to the outside is opened to expose a brightly lit outdoor landscape. Accordingly, as the scene progresses from FIG. 1A to FIG. 1D, overall brightness of the scene gradually increases from FIG. 1A to FIG. 1D due to the opening door, thereby causing a corresponding gradual increase in the panel load, which is shown as the x-axis of the NPC functions 110, 120.

The NPC function 110 is a conventional NPC function that decreases the gain progressively as the panel load, or panel load basis, increases. The conventional NPC function is invariant and is applied uniformly to all images. The NPC function 120, however, is a proposed strategy for dealing with panel loading. The function may be adjusted depending on the scene. The goal is that frames from within a scene fall over a flat region of the NPC function, but that the flat region is allowed to change positions when there is a new scene.

In the image frames of the scene depicted in FIGS. 1A-1D, it may be suitable for the dimly lit areas of the room to be displayed at a constant level of brightness, or it may be suitable for the dimly lit areas to increase in brightness only slightly in response to the increased light coming into the room through the door. However, the global gain, which is shown as the y-axis of the NPC functions 110 is conventionally decreased (e.g., steeply decreased) by the conventionally static NPC function 110 to compensate for the increased panel load. That is, conventional methods of using NPC functions adopt frame-based gain control, wherein the conventional NPC function 110 adjusts the global gain based on only the panel loading for the particular image frame.

Contrastingly, embodiments of the present invention provide a dynamic/variable NPC function, such as the NPC function 120, which uses scene-based gain control, such that a generally stable NPC level is chosen to allow for less change between values/levels of the global gain as the panel load increases during a scene. For example, the NPC function 120 of the present embodiment is a flatter, more horizontal function than the conventional NPC function 110, as depicted in FIGS. 1A-1D. Accordingly, the NPC function 120 may be based on a range of expected panel loads of image frames in a particular scene. This is opposed to a conventional NPC function 110 that is based only on the display's ability to sustain various panel loads. Accordingly, the NPC function 120 of the present embodiment enables reduced fluctuations in the level of the global gain within a scene of images.

Figure 1B:
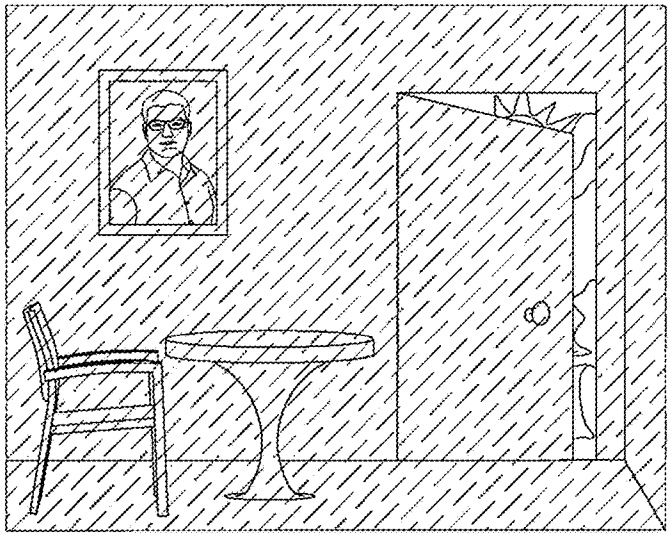
Figure 1B:
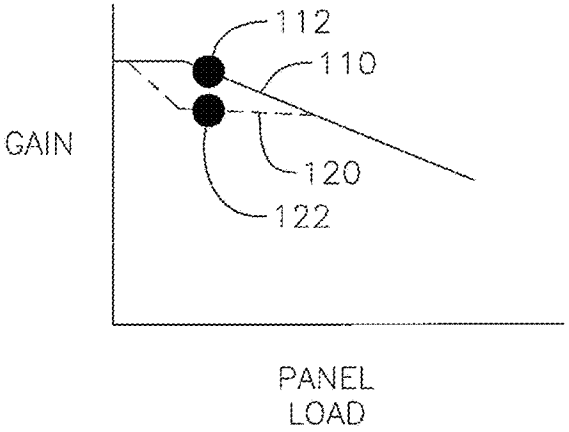
Figure 1D:
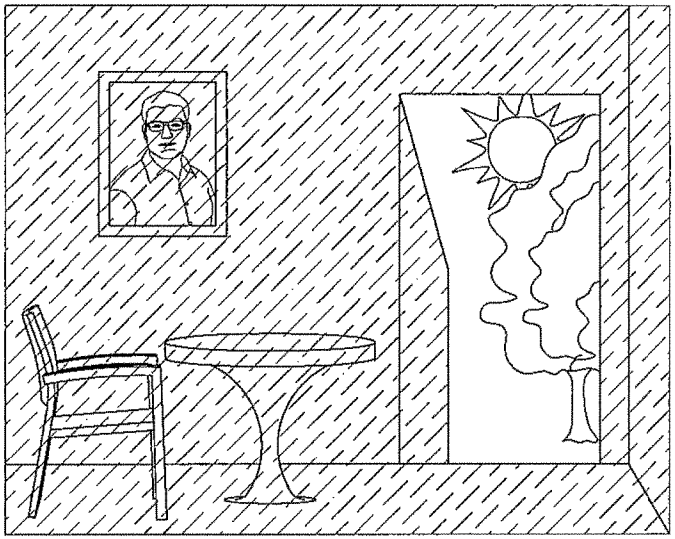
Figure 1D:
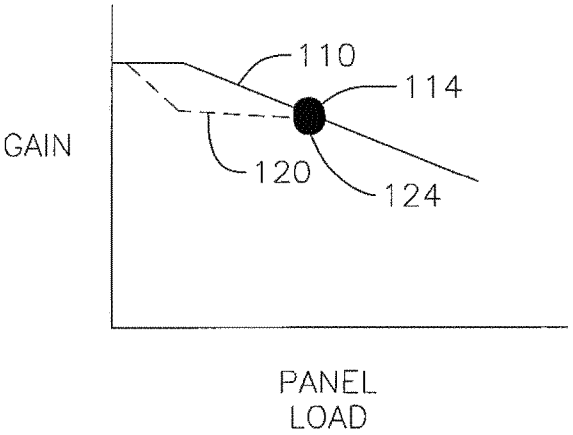
Figure 1C:
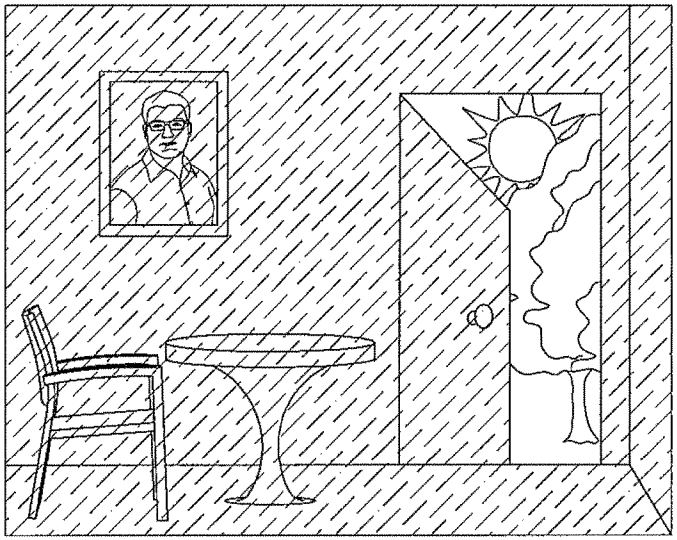
Figure 1C:
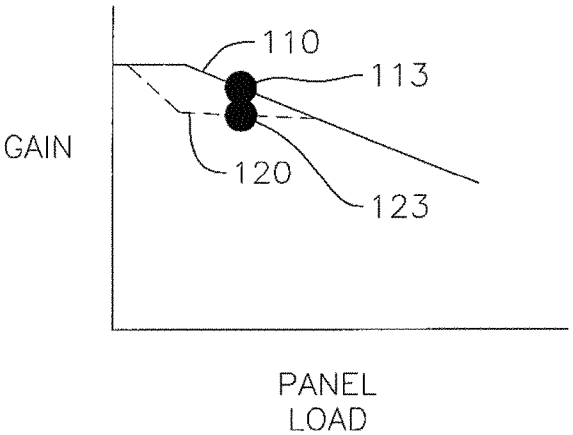

Over the course of the scene depicted in FIGS. 1A, 1B, 1C, and ID, a door opens that increases the panel loading from ~5% to 10%, to 25% to 35%. With conventional NPC, the static NPC function would specify that 5% maps to the gain associated with the points 111, 112, 113, and 114 respectively. By using a tailored NPC function 120 for this scene, the gain associated with point 121, 122, 123, and 124 remains unchanged. In the present example, the NPC function 120 has been precomputed for this entire scene to minimize the change in brightness necessary.

For example, the image frame depicted in FIG. 1D may correspond to a 35% panel load. If this information that a frame from this scene would reach a peak panel load of 35% was available at the time of FIG. 1A (e.g., the information was available to the display system prior to displaying the image frame depicted in FIG. 1D), the present embodiment is able to provide the NPC function 120 that is much flatter over the panel load range (e.g., 5% panel load corresponding to FIG. 1A to 35% panel load corresponding to FIG. 1D). Contrastingly, a conventional NPC function 110 makes no assumptions, and has no additional information about subsequent or past frames, and thus remains invariant.

Accordingly, when compared to the conventional NPC function 110, the NPC function 120 of the present embodiment has a fairly minimal change in the global gain values over a same range of the panel load values. Although the NPC function 120 of the present embodiment depicts an attenuated change in global gain level to achieve the reduction in fluctuations of the global gain level during the scene content of the present example, in other embodiments, the change in global gain level as a function of the panel load may be as little as 0.

In other examples, depending on the images of the video stream being displayed, the panel load may generally increase, may generally decrease, or may be volatile (with no strong trend) during the display of the image frames/images of the video stream. To effectively produce a NPC function that reduces fluctuations of the global gain level during the display of the different images, it may be useful to know a maximum panel load for the scene containing the images. It may also be useful to know additional parameters or metrics of the scene, such as the minimum panel load for the scene.

For example, because each scene of a video stream will have a given range of a panel load, and because different scenes can have ranges and magnitudes of panel loading that greatly vary, it may be useful to divide the video stream into different scenes (e.g., into different time intervals based on detected scene transitions), and to adopt a NPC function that has a fairly stable global gain throughout that scene (e.g., during a corresponding time interval). It may also be useful to adopt different NPC functions, or to provide different global gain values, for different scenes based on the different ranges/magnitudes of panel loading. That is, according to embodiments of the present invention, by dividing up the content of the video stream into different scenes, different NPC functions can be applied to the different scenes to produce abrupt changes in global gain that are not easily perceivable by a user. The transition between different scenes may be determined by calculating one or more different types of statistics for each image frame, by storing those statistics, and by comparing those statistics with corresponding statistics of the previous image frame. When the comparison of the statistics reveal a large enough difference therebetween, then the current or subsequent image frame may be classified as a first image frame of a subsequent scene, and a new (perhaps even significantly different) NPC function may be applied thereto.

As an example, if a first scene of the video stream has a wide range of panel load values/levels (e.g., large fluctuations in brightness), and if a second scene of the video stream has a tighter range of panel load values (e.g., more consistent brightness), display quality can be improved by applying a first NPC function during the first scene that is different than a second NPC function of the second scene. Furthermore, if the first NPC function used during the first scene transitions to the second NPC function used during the second scene at a point at which the first scene changes to the second scene (e.g., at a scene transition corresponding to a sudden or abrupt change in light level demarcating the first and second scenes), the user may not perceive the step change in gain associated from transitioning from the first NPC function to the second NPC function. The shift from the first NPC function to the second NPC function might otherwise be perceived if the change occurred without a dramatic change in the imagery. Such a dramatic change in gain would be masked by a change in the imagery without a stable reference point.

According to embodiments of the present invention, information referred to as dynamic metadata may be used by a display system to select an appropriate NPC function for each scene, and/or may be used to determine when to change from one NPC function to the next (e.g., to determine a scene transition when a first scene transitions to a second scene).

Dynamic metadata may be transmitted with a video signal/input image data, and includes additional information about scene content. Dynamic metadata may include a duration of the scene(s) (e.g., a number of an image frame corresponding to a scene transition separating adjacent scenes), a peak/maximum image brightness of each scene, a minimum image brightness of each scene, an average brightness of an image frame or of scene, a maximum frame average luminance level (MaxFALL), spatial information about image content of the scene(s), and/or suggested color model information (e.g., tonemapping models). Accordingly, dynamic metadata can be used to indicate the time intervals/image frames at which to apply a change between NPC functions without the change being detected by a user viewing the display.

The MaxFALL, which may be part of the dynamic metadata, may be calculated by taking a group of adjacent image frames (e.g., 150 consecutive image frames that comprise a scene), determining the average luminance for each of those image frames, and determining a maximum of the average luminances. MaxFALL for a scene may be used to determine an approximate NPC function that is appropriate for the scene and for the capabilities of the display system. That is, the MaxFALL may effectively be a proxy for the panel load, and therefore may be used to predict the maximum load that will be encountered during the scene, and thus set the NPC function appropriately.

However, it should be noted that two different image frames having the same average luminance level may correspond to different panel loadings, because the MaxFALL is based on non-tonemapped panel loading, whereas the final displayed images will be tonemapped. Furthermore, with LCD displays, the spatial distribution of the image determines which subset of backlight local dimming zones are necessary and what intensity they must use. Accordingly, the NPC function, or an approximate NPC setting, may be further compensated based on additional factors, and the approximate NPC setting may be further compensated/transformed by computing the approximate tonemapped load ratio for the current image frame, and by applying the ratio to the MaxFALL data.

Furthermore, according to one embodiment, an appropriate NPC function may be calculated by: 1) estimating a panel load ratio based on the statistics of an incoming image frame; 2) estimating the maximum scene load by multiplying the MaxFALL by a scene load ratio (SLR) (the SLR is equal to current frame load divided by the raw frame average luminance level); and 3) applying the estimated maximum scene load to determine the NPC function. The current frame load corresponds to a frame load after tonemapping, color correction and any other processing that occurs on the frame, and the frame average luminance corresponds to an average raw pixel value. Accordingly, the SLR may be used as a useful value for predicting a maximum panel load for a given scene.

In another embodiment more readily applicable to LCD displays, the current frame load refers to the load of the backlight emitters for a given frame. The number and intensity of the backlight emitter units will be a function of the spatial pattern of light intensity in the image, and the location and arrangement of the emitters in the backlight. It may also be influenced by other factors including diffuser films and software algorithms for calculation of an emitter control signal.

Figure 2:
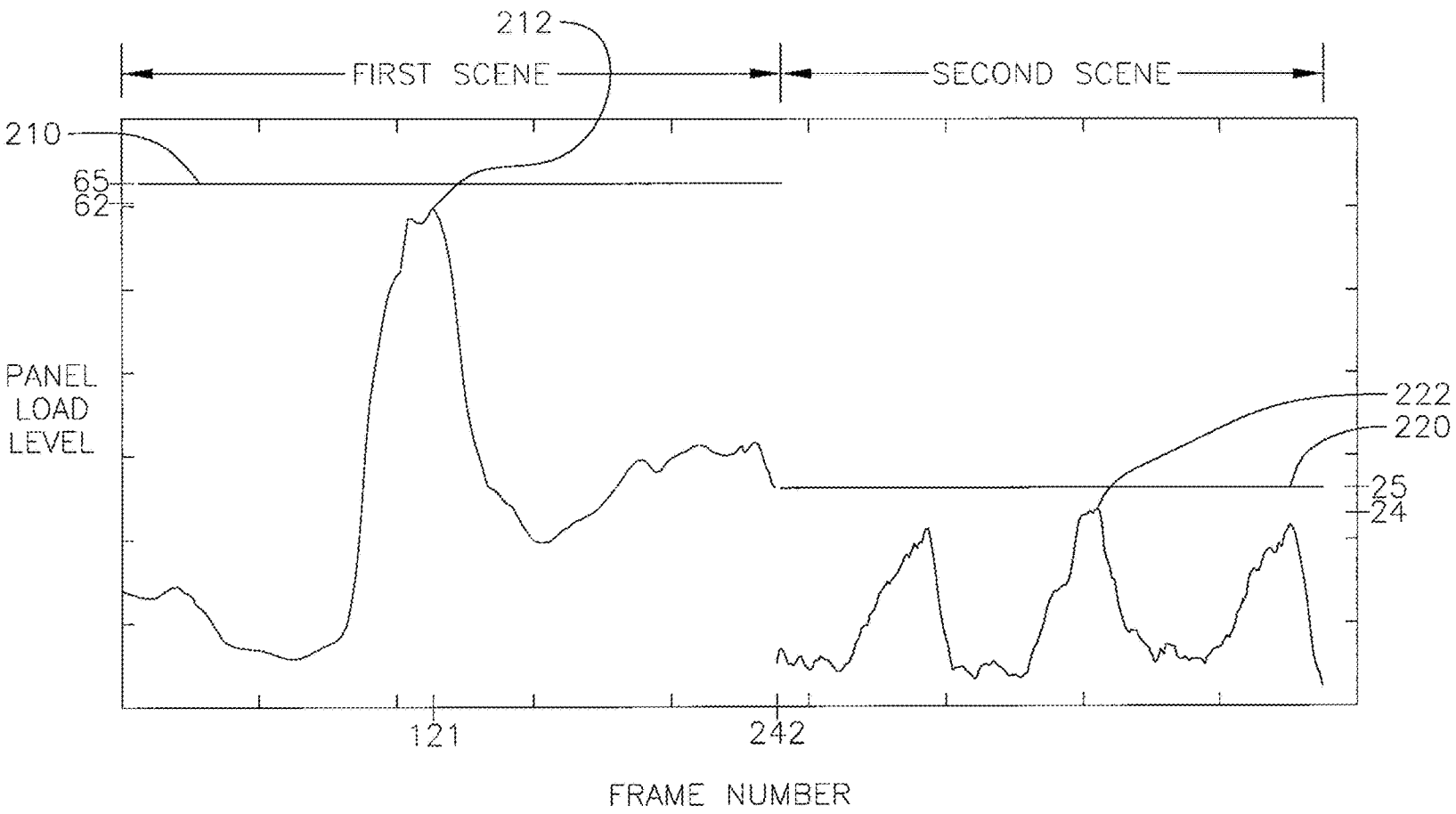
FIG. 2 depicts a panel load level for a plurality of image frames of two consecutive scenes, and depicts corresponding NPC gain corresponding to the image frames, according to an example of an embodiment of the present invention.

FIG. 2 depicts a panel load level for a plurality of image frames of two consecutive scenes, and depicts corresponding steady NPC gain corresponding to the image frames within each scene, according to an example of an embodiment of the present invention.

Referring to FIG. 2, the image data of the present example includes a first scene and a second scene. Dynamic metadata may indicate that the first scene corresponds to image frame numbers 0 to 242, and that the second scene corresponds to image frame numbers 243 to 441 (i.e., a scene transition occurs between image frame number 242 and image frame number 243). A conditioned panel load level for each image frame of the input image data is shown by the graph. The conditioned panel load level is the actual load of the display after all image adjustments. The conditioned panel load level may also be strongly correlated with included dynamic metadata. A stable NPC gain level for scene 1 and scene 2 may be based on the maximum panel load from each scene respectively at 62, and 24. That is, by receiving the dynamic metadata, the display system of the present embodiment may estimate the maximum panel load levels of 62 and 24 for the two scenes respectively, and conduct scene-aware processing to improve display quality, as will be described below.

In the present example, the NPC function has a first NPC gain/NPC gain load signal/NPC function 210 for the first scene set at about 65 based on a first peak conditioned load (e.g., a maximum conditioned panel load level for the first scene) 212 of about 62 occurring around image frame number 121. The first peak conditioned load 212 corresponds to a first MaxFALL occurring at about frame 135. The first NPC function 210 for the first scene may be determined based on the estimated first peak conditioned load 212 of the first scene plus a buffer of, for example, about 5%. That is, the first NPC function 210 may be a buffered NPC level.

Furthermore, in the present example, a second NPC gain setting may be predicated on a peak load for the second scene of 28, which corresponds to a second peak conditioned load 222 having a value of about 24. Accordingly, a second NPC gain/NPC gain load signal/NPC function 220 for the second scene may be set to have a value of about 25 (e.g., the second peak conditioned load value of 24 plus a 5% buffer).

Accordingly, by setting the first and second NPC functions 210 and 220 for the first and second scenes, respectively, the levels of brightness of the displayed images may be shown without any noticeable fluctuations. Furthermore, even though there is a dramatic change in levels between the first and second NPC functions 210 and 220, because the change occurs at the scene transition (e.g., between image frame numbers 242 and 243), the abrupt change in levels may be unnoticed by a user viewing the display, as no fluctuations in the global gain occur within either the first or second scene.

Although the example of the present embodiment depicts a scenario where dynamic metadata is received by the display system to calculate the different NPC functions 210 and 220 and to determine the time of the scene transition, in other embodiments, dynamic metadata may be unable to be used in the prediction of the NPC functions to be applied to different scenes. That is, in the absence of dynamic metadata (or incompatible dynamic metadata), it is not feasible to estimate, in advance, a duration of different scenes or the maximum panel load within a scene. Accordingly, the display system may be unable to determine the expected panel load for the images of the scene until just before the images are to be displayed by a display panel of the display system.

In the absence of metadata, frame-to-frame image statistics can be used to identify dramatic changes that may be indicative of a scene transition. Accordingly, by predicting the scene transition, the NPC function may be changed without a visible impact on image quality. Furthermore, the NPC function may be set such that there is a buffer region, which may be based on typical scene statistics, at the onset of each scene with a fairly flat NPC function. By making overflow of the buffered region rare, changes in global gain within a scene may occur relatively infrequently and produce limited or no visible artifacts.

For example, by analyzing the first image frame of a scene in a sequence of image frames in light of typical panel load levels that occur in a typical scene, much of the high-frequency volatility can be removed without having a completely accurate estimate of the full scene. Such analysis may be performed offline and programmed into the algorithms. Or it could be produced using adaptive circuits having access to previous scene or image statistics. Accordingly, the display system may predict that for a given first frame of a scene, the panel load typically operates within a range over the duration of the scene, thereby improving the visual quality of the displayed images. Accordingly, if the panel load goes up or down, the display may be able to handle the changes in the panel load by using a customized NPC function for the current scene. In cases in which there is underestimation of the panel load change, an upper envelope of the NPC function, or the NPC envelope function, of the display may be followed to protect the circuitry of the display. The upper envelope of the NPC function may be determined by a manufacturer of the display system, and may correspond to a maximum gain level that the display system is able to handle for each panel load.

Figure 3:
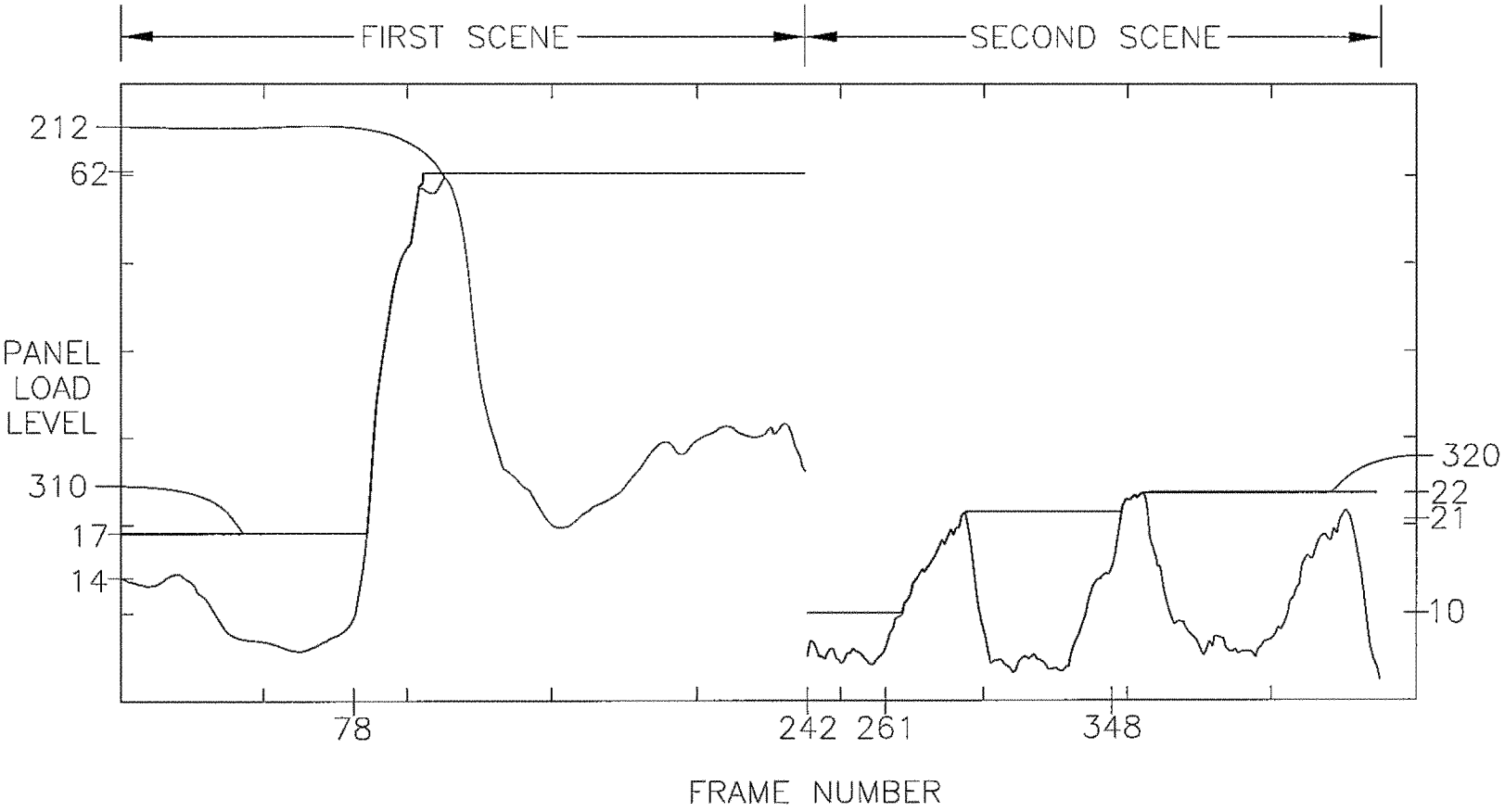
FIG. 3 depicts the panel load level for the plurality of image frames shown in in the example of FIG. 2, and depicts corresponding NPC gain corresponding to the image frames, according to another embodiment of the present invention.

FIG. 3 depicts the panel load level for the plurality of image frames shown in the example of FIG. 2, and depicts corresponding NPC gain corresponding to the image frames, according to another embodiment of the present invention.

Referring to FIG. 3, even when dynamic metadata is available, and even when a buffered NPC level is used, there may be scenes in which the buffer level is exceeded, and the current image calls for a panel load that exceeds that allowed for the given gain setting (e.g., a first NPC function 310). Accordingly, the panel of the display system may use the upper envelope of a NPC function to adjust the gain level to accommodate the higher than anticipated images. However, excessive brightness fluctuations may be avoided by imposing hysteresis (e.g., a hysteresis function) on the NPC function by disallowing the brightness to immediately increase (e.g., preventing the NPC function to immediately regress to the lower load estimate) as soon as the panel load decreases. Such a hysteresis effect on the NPC setting could be maintained until the next scene is detected.

In the present embodiment, a new scene (i.e., the first scene) may be detected at image frame number 0, and the first image frame of the first scene may have an initial conditioned panel load of 14. Accordingly, the first NPC function 310 may be buffered at 25% to achieve a value of 17. However, around image frame number 78, a buffer overflow occurs at an out-of-range frame (e.g., a frame that is out of the anticipated NCP function range), thereby causing the first NPC function 310 to be readjusted. The NPC gain level of the first NPC function 310 may decrease to accommodate the increasing panel load, and the total panel load specified by the image may reach a value of 62, which corresponds to the peak conditioned load level of the first peak conditioned load 212 occurring in the first scene. After the elevated panel loading is observed around, for example, frame 100, the NPC function maintains the peak panel load for its basis of determining the appropriate gain setting, which prevents any further gain changes to occur during the scene.

Upon detecting a scene transition to the second scene after image frame number 242. The conditioned panel load at a beginning of the second scene may be determined to be 8, and a buffered NPC panel load basis value for the second NPC function 320 may be set at a value of 10. However, a buffer overflow occurs around image frame number 261, such that the NPC peak loading estimate is revised upwards (e.g., a value of about 21). Thereafter, an additional buffer overflow of the readjusted second NPC function 320 may occur around image frame number 348, such that the second NPC function 320 is again readjusted and sustained at a higher level (e.g., a NPC panel load basis value of about 22).

Accordingly, despite not analyzing metadata, by adjusting the NPC load upwards as suitable throughout a scene, and by detecting scene transitions, display quality may be improved. That is, by providing a run-time NPC function that employs an asymmetrical response to bright image frames and dark image frames to reduce volatility of the global gain, the present embodiment may improve a visual experience of a user.

Figure 4:
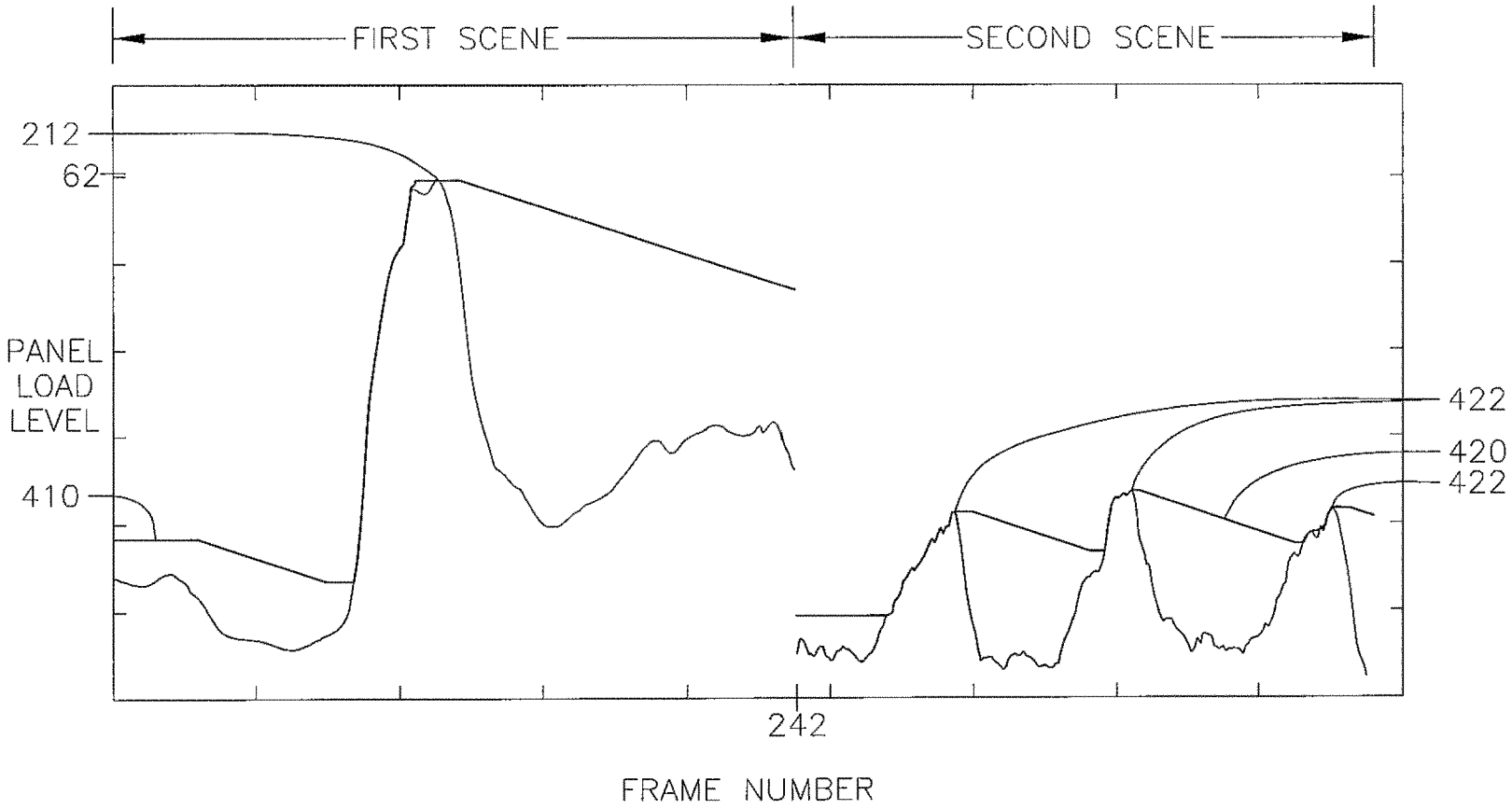
FIG. 4 depicts the panel load level for the plurality of image frames shown in in the example of FIG. 2, and depicts corresponding NPC gain corresponding to the image frames, according to yet another embodiment of the present invention.

FIG. 4 depicts the panel load level for the plurality of image frames shown in in the example of FIG. 2, and depicts corresponding NPC function corresponding to the image frames, according to yet another embodiment of the present invention.

Referring to FIG. 4, in another embodiment, the hysteresis function described with respect to FIG. 3 may be modified to allow for recovery from a higher brightness, the recovery being associated with detection of a lower panel load. In the present embodiment, the display system incorporates a rule of reducing the NPC panel load basis value by a given amount each image frame whenever panel load is much lower than anticipated (e.g., a standard rate of reduction of the NPC gain following a localized peak in panel load level). Accordingly, after a peak conditioned load level is reached, the readjusted NPC gain may be reduced by a relatively small amount for each image frame such that the displayed images may achieve full brightness again. The recovery pace is controlled to minimize the visibility of the gain adjustment when it does not occur at a scene boundary.

For example, a new scene (e.g., the first scene) may be detected at image frame number 0, where the conditioned panel load level is determined to have a value of 14, and the first NPC panel load basis 410 of the first scene may be initially set to a value of 17 (e.g., by incorporating a buffer of 25%). Once low panel load is detected, this exemplary implementation of the concept of brightness recovery of the present embodiment causes the first NPC panel load basis 410 to be slowly reduced (which could permit elevating the gain level associated with the modified NPC function). However, once buffer overflow occurs, the value of the first NPC panel load basis 410 is readjusted upward to a peak of 62 corresponding to the first peak conditioned load 212. However, thereafter a low panel load is again detected, and gradual recovery occurs such that the value of the first NPC panel load basis 410 slowly decreases, frame-by-frame. The rate of decrease of the first NPC panel load basis 410 may be based on a percentage of the global gain value (i.e. nonlinear function), or may be a simple constant rate of decrease.

When the scene transition is detected after the image frame number 242, the NPC panel load basis value may be abruptly changed to the second NPC panel load basis 420 having an initial value of 10 to correspond to the detected panel load of 8 with a 25% buffer. Once buffer overflow occurs, the second NPC panel load basis 420 may be readjusted, and recovery may occur after local maximums/peaks 422 occurring within the second scene.

Accordingly, by allowing for gradual recovery of brightness after local peaks in brightness, slight changes in the NPC gain value between image frames may go unnoticed by a user viewing a video stream on the display system.

Although the embodiments described above correspond primarily to OLED displays, concepts of the above embodiments may be applied to liquid crystal displays (LCDs). That is, local dimming LCDs may have a similar issue regarding backlight loading, in that in some systems all of the backlights of the LCD cannot be driven at full power simultaneously, and thus they may also undergo reduction of the global gain as the load increases. Concepts that are similar to the embodiments described above for OLED displays can be applied to LCDs with a few modifications.

One such modification, for example, instead of calculating panel load based on aggregate pixel demand, the content must be further conditioned to calculate the backlight demand/the power load of the backlights of the LCD. Because there can be significant differences in backlight load depending on spatial distribution of bright emitters, meaning that backlight load can be very different than mean image brightness (i.e. in LCD backlight, a modest number of bright pixels may require a large fraction of the backlight LED zones to be driven to a bright output), a NPC function can therefore be used to prevent overloading of the backlights. In cases of LCDs receiving dynamic metadata, the MaxFALL would require additional conditioning before it could be used to control global gain.

For example, the frame average luminance may be calculated based on original image content. Then, the image data for an image frame may be tonemapped. After the tonemapping, a global dimming algorithm/function/function may be applied to estimate backlight signal. Thereafter, the total load of the backlight signal may be determined, and a compensation factor may be calculated based on an estimated maximum backlight load being equal to the backlight load fraction of a reference image frame multiplied by the MaxFALL divided by the unprocessed average luminance of the reference image frame. That is, $$\text{Estimated Max Backlight Load} = \text{Backlight_load}_{ref\ frame}\frac{MaxFALL}{\text{Unprocessed Average Luminance}_{ref\ frame}}$$

The reference image frame could be the first image frame of a new scene, or it could be updated periodically throughout the scene along with a filter to gradually change the global gain settings.

In another embodiment, the NPC function may be further modified to reduce energy consumption. For example, in a dual modulated LCD, the NPC function may be further adjusted to effectively cause the LCD's backlight to operate at a lower brightness. Thus, the NPC function modifications may therefore take into account the scene data as well as whether the display is in a low-power or energy savings mode, reducing display power usage. Similarly, the NPC function may also be modified to benefit thermal management. For example, the NPC function may be further modified to reduce display brightness when the operating temperature of the display exceeds a threshold to reduce the heat output of the display panel.

Accordingly, embodiments of the present invention may also be applied either to OLED displays or to LCDs to improve visual quality, and the above described embodiments of the present invention are able to provide a method and mechanism for calculating a NPC function to improve display quality of a display system.

Figure 5:
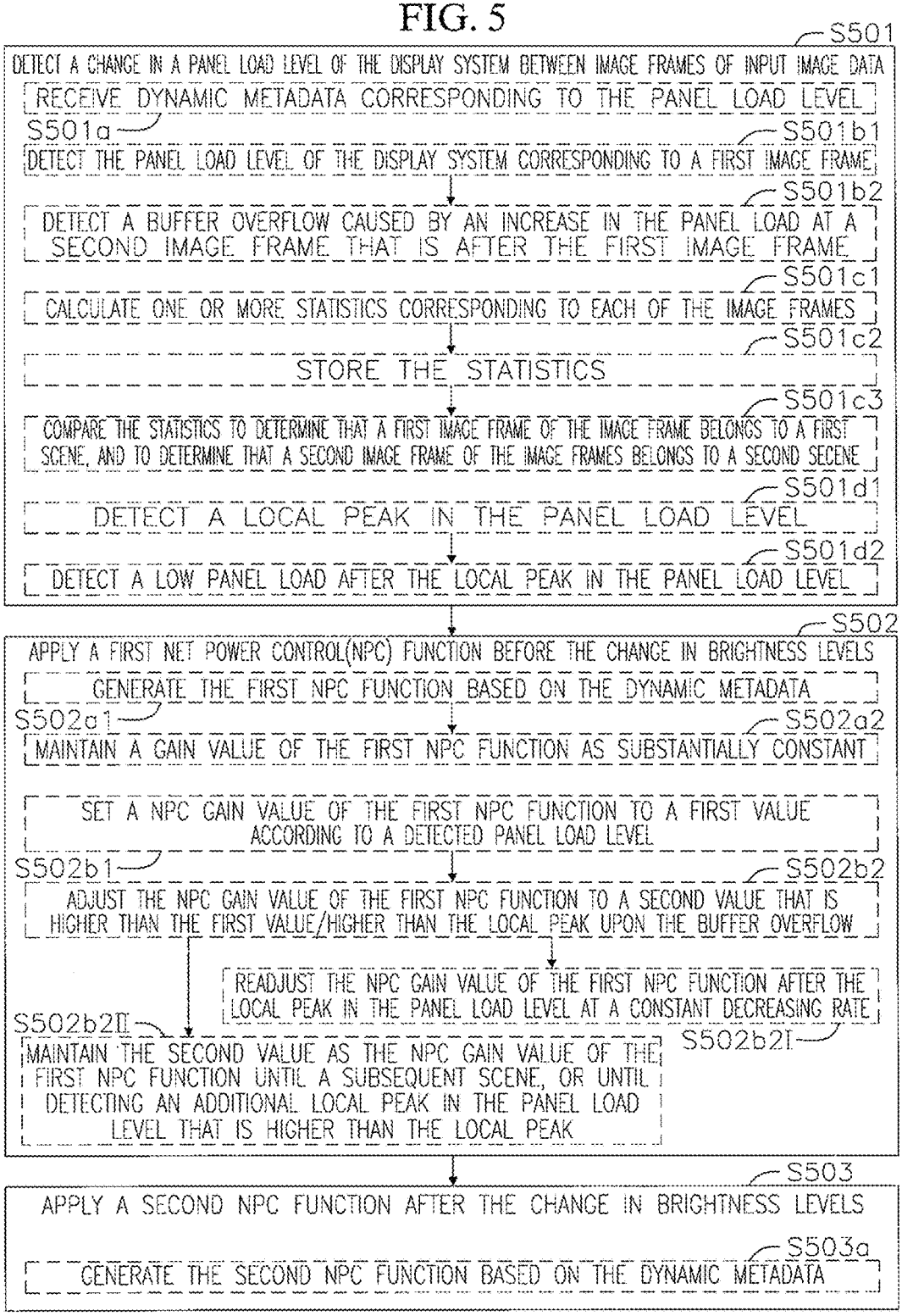
FIG. 5 is a flowchart of a NPC method for driving a display according to an embodiment of the present invention.

FIG. 5 is a flowchart of a NPC method for driving a display according to an embodiment of the present invention.

Generally, a display system according to an embodiment of the present invention may receive an image stream, and may determine for each image frame (or for every nth image frame, n being an integer) whether the image frame corresponds to a new scene. If the image frame does not correspond to a new scene, then the NPC function undergoes minimal change (image gain is held constant), and the display system continues to use the NPC function. If the image frame does correspond to a new scene, however, then the display system may determine an estimated maximum panel load for the new scene, may generate a new, different NPC function corresponding to the new scene, and may then update the NPC function.

At operation S501, a change in a panel load level of the display system may be detected between image frames of input image data (e.g., the display system may detect a change in panel load level between image frame numbers 242 and 243 of the input image data, as shown in FIGS. 2-4).

As an example of detecting a change in the panel load level, at operation S501*a* dynamic metadata corresponding to the panel load level may be received (e.g., the display system may receive dynamic metadata indicating that there is an abrupt change in the estimated panel load for the scene beginning after image frame number 242).

As another example of detecting a change in the panel load level, at operation S501*b*1 the panel load level of the display system corresponding to a first image frame may be detected, then, at operation S501*b*2 a buffer overflow caused by an increase in the panel load level at a second image frame that is after the first image frame may be detected (e.g., the display system may detect the panel load level of image frame number 0, then the display system may detect a buffer overflow caused by an increase in the panel load level at image frame number 78, as shown in FIG. 3).

As yet another example of detecting a change in the panel load level, at operation S501*c*1 one or more statistics corresponding to each of the image frames may be calculated, then, at operation S501*c*2 the statistics may be stored, and thereafter, at operation S501*c*3, the statistics may be compared to determine that a first image frame of the image frames belongs to a first scene, and to determine that a second image frame of the image frames belongs to a second scene (e.g., the display system may calculate and store statistics corresponding to image frame numbers 242 and 243, and may then compare the statistics to determine that image frame number 242 belongs to the first scene, and that image frame number 243 belongs to the second scene, as shown in FIGS. 3 and 4).

As an additional example of detecting a change in the panel load level, at operation S501*d*1 a local peak in the panel load level may be detected, then, at operation S501*d*2 a low panel load may be detected after the local peak in the panel load level (e.g., the display system may detect a local peak/peak conditioned load 212 in the panel load level at around image frame number 121, as shown in FIG. 2, and may then detect a lower panel load after the local peak 212).

At operation S502, a first NPC function may be applied to a first scene occurring before the change in brightness levels (e.g., the display system may apply a first NPC function 210 to a first scene occurring before the change in brightness levels occurring after image frame number 242).

As an example of applying the first NPC function, at operation S502*a*1 the first NPC function may be generated based on the dynamic metadata, and at operation S502*a*2, a panel load basis value of the first NPC function may be maintained as substantially constant for the first scene (e.g., the display system may generate and apply the first NPC function 210 based on received dynamic metadata corresponding to the first scene, and may maintain the first NPC function 210 at a substantially constant panel load basis value of about 65, as shown in FIG. 2).

As another example of applying the first NPC function, at operation S502*b*1, a NPC panel load basis value of the first NPC function may be set to a first value according to a detected panel load level, and then, at operation S502*b*2, the NPC panel load basis value of the first NPC function may be adjusted to a second value that is higher than the first value, or that is higher than the local peak upon the buffer overflow (e.g., the display system may initially set the NPC panel load basis value of the first NPC function 310 to a first panel load basis value of about 17 according to a detected panel load level after image frame number 0, and then the display system may adjust the NPC panel load basis value of the first NPC function 310 to a second panel load basis value of about 62, which is higher than the first value of about 17, or that is higher than the local peak 212, as shown in FIG. 3).

Once the NPC panel load basis value of the first NPC function is adjusted to a second value, then, at operation S502*b*2I, the NPC panel load basis value of the first NPC function may be readjusted after the local peak in the panel load level at a constant decreasing rate (e.g., the display system may readjust the panel load basis value of the first NPC panel load basis 410 after the local peak 212 in the panel load level at a constant decreasing rate, as shown in FIG. 4). Alternatively, at operation S502*b*2II the second value may be maintained as the NPC panel load basis value of the first NPC function until a second scene, or until detecting an additional local peak in the panel load level that is higher than the local peak (e.g., the display system may maintain the panel load basis value of the first NPC function 310 at about 62 until the second scene occurring after image frame number 242, as shown in FIG. 3, or, the display system may maintain a panel load basis value of the second NPC function 320 at around 21 after a first local peak in the panel load level occurring after image frame number 261 until detecting a second local peak in the panel load level after image frame number 348, as shown in FIG. 3).

At operation S503 a second NPC function may be applied after the change in brightness levels (e.g., the display system may apply a second NPC function 220, which is different than the first NPC function 210, at a second scene following the change in brightness levels detected between image frame numbers 242 and 243, as shown in FIG. 2). For example, at operation S503*a*, the second NPC function may be generated based on the dynamic metadata (e.g., the display system may generate the second NPC function 220 based on the received dynamic metadata). As an example, the dynamic metadata may include information corresponding to at least one of a duration of one of the first or second scenes, a peak image brightness of one of the first or second scenes, a minimum image brightness one of the first or second scenes, an average brightness of an image frame of one of the first or second scenes, a maximum frame average luminance level (MaxFALL) of one of the first or second scenes, spatial information about image content of one of the first or second scenes, or suggested color model information of one of the first or second scenes.

Figure 6:
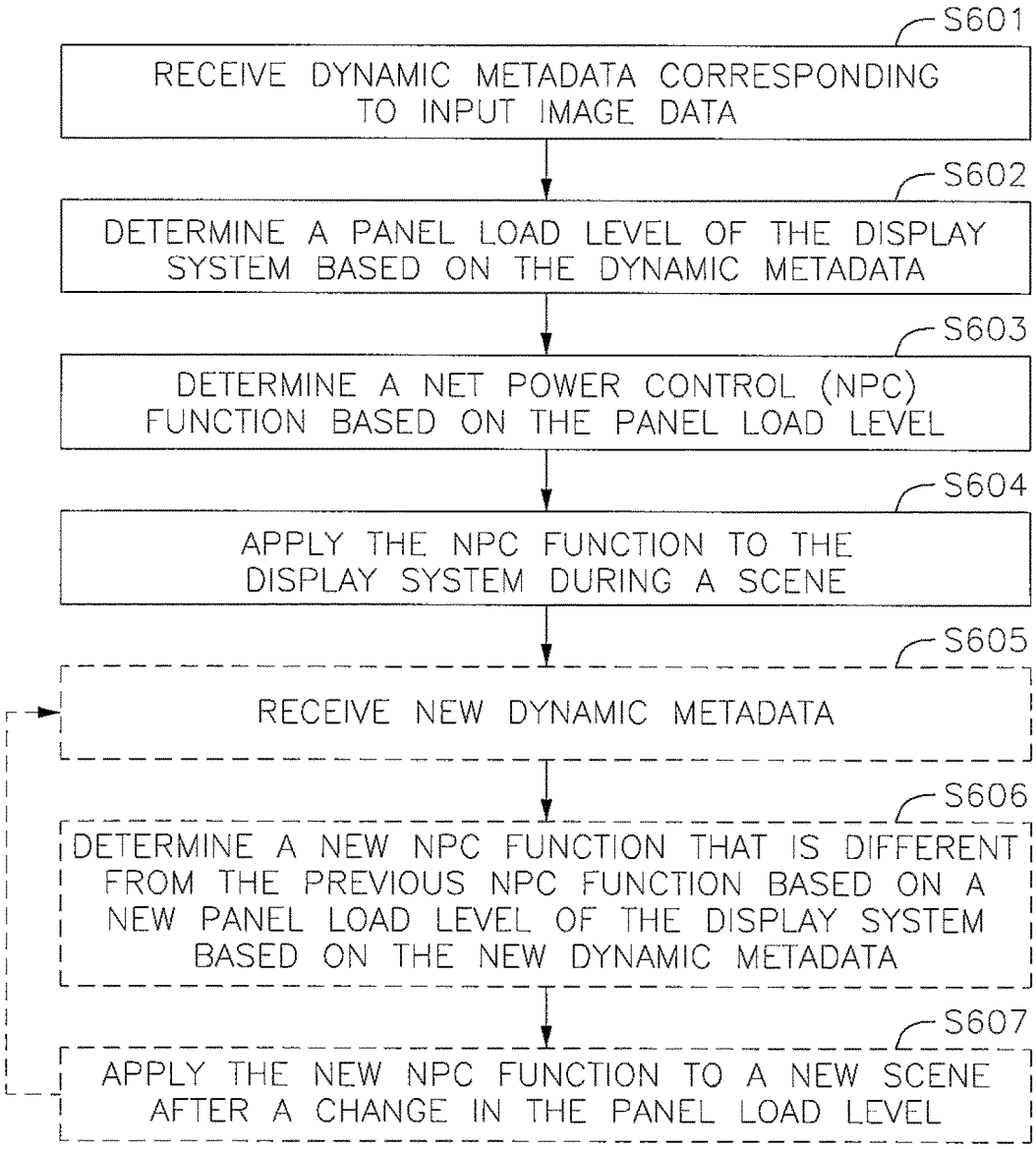
FIG. 6 is a flowchart of a NPC method for driving a display according to another embodiment of the present invention.

FIG. 6 is a flowchart of a NPC method for driving a display according to another embodiment of the present invention.

At operation S601, dynamic metadata corresponding to input image data may be received, and at operation S602, a panel load level of the display system may be determined based on the dynamic metadata (e.g., the display system may receive image data including dynamic metadata, and may determine a panel load level of the display system based on the dynamic metadata). Thereafter, at operation S603, an NPC function may be determined based on the panel load level, and at operation S604, the NPC function may be applied to the display system during a scene (e.g., the display system may determine and may apply the first NPC function 210 during the first scene based on the determined panel load level, as shown in FIG. 2). Furthermore, at operation S605, new dynamic metadata may be received, and when new dynamic metadata is received, at operation S606, a new NPC function that is different from the previous NPC function may be determined based on a new panel load level of the display system based on the new dynamic metadata, and at operation S607, the new NPC function may be applied to a new scene after a change in the panel load level (e.g., the display system may receive dynamic metadata corresponding to the second scene, and may determine and apply the second NPC function 220 to the second scene after the change in the panel load level/after image frame number 242, the first NPC function 210 and the second NPC function 220 being different from each other, as shown in FIG. 2). The new NPC function may then be applied until new dynamic metadata indicating a new scene corresponding to a different panel load level is received. In other embodiments, the display system may additionally determine whether images of the scene fall within a stable region of the NPC function that is applied, and if not, the NPC function may be updated and applied to the display system.

According to the above described embodiments, by using a display system to change the global gain value between image frames that correspond to different (e.g., drastically different) panel load levels, the change in the global gain value may be undetected by a user, and display quality of the display system may thereby be improved.

While this disclosure has been described in connection with what is presently considered to be practical exemplary embodiments of the present invention, it is to be understood that the present invention is not limited to the disclosed embodiments, but, on the contrary, is intended to cover various suitable modifications and equivalent arrangements included within the spirit and scope of the appended claims and their equivalents.

What is claimed is:

1. A method of power control of a display system, the method comprising:

receiving first dynamic metadata corresponding to input image data;

determining, at a beginning of a first scene, an expected panel load level of the display system based on the first dynamic metadata, the expected panel load level corresponding to one or more image frames to be subsequently displayed after the beginning of the first scene; and applying a first net power control (NPC) function to the display system during the first scene based on the expected panel load level, wherein the first dynamic metadata is received prior to display of the beginning of the first scene, and wherein the first NPC function is applied during an entirety of the first scene.

2. The method of claim 1, further comprising:

receiving a second dynamic metadata corresponding to an input image data from a second scene;

determining a panel load level of the display system based on the second dynamic metadata; and applying a second NPC function to the display system during the second scene based on the panel load level.

3. The method of claim 1, further comprising:

detecting a detected panel load level of the display system corresponding to a first image frame of the first scene;

setting a NPC panel load basis value of the first NPC function to a first value according to the detected panel load level;

detecting a panel load that exceeds an anticipated NPC function range caused by an increased panel load level at a second image frame of the first scene that is after the first image frame, and that is an out-of-range frame; and adjusting the NPC panel load basis value of the first NPC function to a second value that is higher than the first value upon the out-of-range frame.

4. The method of claim 3, further comprising detecting a local peak in a plurality of panel load levels during the first scene, wherein the second value is higher than the local peak.

5. The method of claim 4, further comprising maintaining the second value as the NPC panel load basis value of the first NPC function until a second scene, or until detecting an additional local peak in another plurality of panel load levels that is higher than the local peak.

6. The method of claim 4, further comprising:

detecting a low panel load after the local peak; and readjusting the NPC panel load basis value of the first NPC function after the local peak at a constant decreasing rate.

7. The method of claim 1, further comprising applying a second NPC function to a second scene occurring after a change in panel load levels, the first NPC function and the second NPC function being different.

8. The method of claim 1, wherein the first dynamic metadata comprises information corresponding to at least one of:

a duration of one of the first scene;

a peak image brightness of the first scene;

a minimum image brightness the first scene;

an average brightness of an image frame of the first scene;

a maximum frame average luminance level (MaxFALL) of the first scene;

spatial information about image content of the first scene; or suggested color model information of the first scene.

9. The method of claim 1, wherein the determining a change of scenes between image frames comprises:

calculating one or more statistics corresponding to each of image frames corresponding to the input image data;

storing the statistics; and comparing the statistics to determine that a first image frame of the image frames belongs to the first scene, and to determine that a second image frame of the image frames belongs to a second scene.

10. The method of claim 1, further comprising setting a NPC function such that it minimizes fluctuations in image gain.

11. The method of claim 1, wherein the first NPC function is further based on a low power mode.

12. The method of claim 1, wherein the first NPC function is further based on an operating temperature of the display system exceeding a temperature threshold.

13. A display system comprising:

a display panel for displaying images according to input image data;

a processor; and a memory, wherein the memory has stored thereon instructions that, when executed by the processor, causes the processor to:

detect dynamic metadata corresponding to the input image data;

determine, prior to displaying an initial image frame, an expected panel load level of the display system based on the dynamic metadata, the expected panel load level corresponding to one or more image frames to be subsequently displayed after the initial image frame;

apply a first net power control (NPC) function to the display system during a first scene based on the expected panel load level;

detect an interruption of a sequence of the image frames of the first scene; and apply a second NPC function to a second scene occurring after the interruption, the first and second NPC functions being different, wherein the dynamic metadata is received prior to display of a beginning of the first scene, and wherein the first NPC function is applied during an entirety of the first scene.

14. The display system of claim 13, wherein the instructions, when executed by the processor, further cause the processor to:

detect a detected panel load level of the display system corresponding to a first image frame of the first scene;

set a NPC panel load basis value of the first NPC function to a first value according to the detected panel load level;

detect an excess in load caused by a change in the input image data at a second image frame of the first scene that is after the first image frame; and adjust the first NPC function to a second function such that a gain level is lower and thus more sustainable than the first value upon the excess in load.

15. The display system of claim 14, wherein the instructions, when executed by the processor, further cause the processor to detect an elevated panel load level during the first scene, wherein the second function is higher than the elevated panel load level.

16. The display system of claim 15, wherein the instructions, when executed by the processor, further cause the processor to maintain the second function as the NPC panel load basis value for determining an appropriate first NPC function until a second scene, or until detecting an additional elevated panel load level that is higher than the elevated panel load level.

17. The display system of claim 15, wherein the instructions, when executed by the processor, further cause the processor to:

detect a low panel load after the elevated panel load level; and readjust the NPC panel load basis value of the first NPC function after the elevated panel load level at a measured rate.

18. The display system of claim 13, wherein the instructions, when executed by the processor, further cause the processor to apply a second NPC function to a second scene occurring after a change in panel load level, the first NPC function and the second NPC function being different.

19. The display system of claim 13, wherein the dynamic metadata comprises information corresponding to at least one of:

a duration of one of the first scene or of a second scene;

a peak image brightness of one of the first or second scenes;

a minimum image brightness one of the first or second scenes;

an average brightness of an image frame of one of the first or second scenes;

a maximum frame average luminance level (MaxFALL) of one of the first or second scenes;

spatial information about image content of one of the first or second scenes; or suggested color model information of one of the first or second scenes.

20. The display system of claim 13, wherein the instructions that cause the processor to determine a panel load level of the display system cause the processor to:

calculate one or more statistics corresponding to each of image frames corresponding to the input image data;

store the statistics; and compare the statistics to determine that a first image frame of the image frames belongs to the first scene, and to determine that a second image frame of the image frames belongs to a second scene.

21. The display system of claim 13, wherein the instructions, when executed by the processor, further cause the processor to maintain a gain value of the first NPC function as substantially constant for the first scene.

22. The display system of claim 13, wherein the instructions, when executed by the processor, further cause the processor to detect an interruption of a sequence of like frames of the input image data corresponding to a same scene using a dynamic metadata.

23. The method of claim 1, wherein the determining a change of scenes between image frames comprises detecting an image frame corresponding to a change in a brightness level.

24. The method of claim 23, wherein the detecting an image frame corresponding to a change in a brightness level comprises determining a panel load of the display system.

25. A method of power control of a display system, the method comprising:

receiving first dynamic metadata corresponding to input image data;

determining, at a beginning of a first scene, an expected panel load level of the display system based on the first dynamic metadata, the expected panel load level corresponding to one or more image frames to be subsequently displayed after the beginning of the first scene;

applying a first net power control (NPC) function to the display system during the first scene based on the expected panel load level;

detecting a detected panel load level of the display system corresponding to a first image frame of the first scene;

setting a NPC panel load basis value of the first NPC function to a first value according to the detected panel load level;

detecting a panel load that exceeds an anticipated NPC function range caused by an increased panel load level at a second image frame of the first scene that is after the first image frame, and that is an out-of-range frame;

adjusting the NPC panel load basis value of the first NPC function to a second value that is higher than the first value upon the out-of-range frame; and detecting a local peak in a plurality of panel load levels during the first scene, wherein the second value is higher than the local peak.

* * * * *